US010537977B2

(12) United States Patent
Applegarth et al.

(10) Patent No.: US 10,537,977 B2
(45) Date of Patent: Jan. 21, 2020

(54) CARBON DIOXIDE COMPRESSION AND DELIVERY SYSTEM

(71) Applicant: SAES PURE GAS, INC., San Luis Obispo, CA (US)

(72) Inventors: Charles H Applegarth, San Luis Obispo, CA (US); Matthew S Browning, San Luis Obispo, CA (US)

(73) Assignee: SAES Pure Gas, Inc., San Luis Obispo, CA (US)

( * ) Notice: Subject to any disclaimer, the term of this patent is extended or adjusted under 35 U.S.C. 154(b) by 0 days.

(21) Appl. No.: 15/532,439

(22) PCT Filed: Feb. 1, 2017

(86) PCT No.: PCT/IB2017/050532
§ 371 (c)(1),
(2) Date: Jun. 1, 2017

(87) PCT Pub. No.: WO2017/134570
PCT Pub. Date: Aug. 10, 2017

(65) Prior Publication Data

US 2018/0200867 A1 Jul. 19, 2018

Related U.S. Application Data

(60) Provisional application No. 62/291,505, filed on Feb. 4, 2016.

(30) Foreign Application Priority Data

Mar. 3, 2016 (IT) ..... 102016000022542

(51) Int. Cl.
*B24C 1/00* (2006.01)
*B24C 3/32* (2006.01)
*F17C 7/04* (2006.01)

(52) U.S. Cl.
CPC ..... *B24C 1/003* (2013.01); *B24C 3/322* (2013.01); *F17C 7/04* (2013.01); *F17C 2221/013* (2013.01); *F17C 2227/0107* (2013.01); *F17C 2227/0304* (2013.01); *F17C 2227/0379* (2013.01); *F17C 2227/047* (2013.01)

(58) Field of Classification Search
CPC .. F17C 13/002; F17C 7/04; F17C 2227/0376; F17C 2227/0107; F17C 2227/0379; F17C 7/02; F25J 2235/04; F25J 1/0257; F25J 2230/80; F25J 3/067; B24C 1/003; B24C 3/322
See application file for complete search history.

(56) References Cited

U.S. PATENT DOCUMENTS 4,593,529 A 6/1986 Birochik
6,889,508 B2 5/2005 Leitch et al.
2003/0188540 A1* 10/2003 Van Winkle ..... B67D 1/0869 62/3.64
2004/0079089 A1* 4/2004 Wallach ..... A61M 1/369 62/3.2

(Continued)

*Primary Examiner* — Keith M Raymond
*Assistant Examiner* — Webeshet Mengesha
(74) *Attorney, Agent, or Firm* — SAES Pure Gas, Inc.

(57) ABSTRACT

The present invention is embodied in a carbon dioxide compression and delivery device that uses a plurality of reversible thermoelectric devices and to a method to operate such carbon dioxide compression and delivery device.

19 Claims, 4 Drawing Sheets

(56) References Cited

U.S. PATENT DOCUMENTS

| | | | | |
|---|---|---|---|---|
| 2004/0089335 | A1 | 5/2004 | Bingham | |
| 2009/0151700 | A1* | 6/2009 | Kondoh | F02M 37/0052 123/457 |
| 2014/0367479 | A1 | 12/2014 | Jackson et al. | |
| 2015/0377750 | A1* | 12/2015 | Scipolo | G01N 1/2205 73/29.01 |
| 2016/0022345 | A1* | 1/2016 | Baust | A61B 18/02 606/21 |

* cited by examiner

CARBON DIOXIDE COMPRESSION AND DELIVERY SYSTEM

BACKGROUND

Carbon dioxide ($CO_2$) compression and delivery systems can be used in many industrial applications, for example, a quite diffused employ is for the cleaning of semiconductors. For this application, the flow, delivery characteristics, and gas quality (especially in term of contaminants) are of paramount importance.

Carbon dioxide substrate cleaning where small carbon dioxide particles agglomerate into large snowflakes is described in the U.S. Pat. No. 5,125,979 of Swain et al. More particularly, Swain et al. describes a cleaning process involving expanding carbon dioxide from an orifice into a thermally insulated chamber to form small carbon dioxide particles, retaining the small carbon dioxide particles in the insulating chamber until the small carbon dioxide particles agglomerate into large snowflakes, entraining the large snowflakes in a high velocity vortex of inert gas to accelerate the large snowflakes, and directing a stream of the inert gas and accelerated large snowflakes against the surface of a substrate to be cleaned.

U.S. Pat. No. 6,889,508 of Leitch et al. describes a carbon dioxide purification and supply system, requiring the presence of a purifying filter and elements such as receiver tanks in order to manage and handle intermediate liquid carbon dioxide. More particularly, Leitch et al. describe a batch process and apparatus for producing a pressurized liquid carbon dioxide stream including distilling a feed stream of carbon dioxide vapor off of a liquid carbon dioxide supply, introducing the carbon dioxide vapor feed stream into at least one purifying filter, condensing the purified feed stream within a condenser to form an intermediate liquid carbon dioxide stream, introducing the intermediate liquid carbon dioxide stream into at least one high-pressure accumulation chamber, heating the high pressure accumulation chamber to pressurize the liquid carbon dioxide contained therein to a delivery pressure, delivering a pressurized liquid carbon dioxide stream from the high-pressure accumulation chamber, and discontinuing delivery of the pressurized liquid carbon dioxide stream for replenishing the high pressure accumulation chamber.

US patent application 2015/0253076 of Briglia et al. discloses a method and apparatus for purifying and condensing carbon dioxide by means of multiple vessels connected in series. More particularly, a carbon dioxide-rich mixture is cooled in a first brazed aluminum plate-fin heat exchanger, at least one fluid derived from the cooled mixture is sent to a purification step having a distillation step and/or at least two successive partial condensation steps, the purification step produces a carbon dioxide-depleted gas which heats up again in the first exchanger, the purification step produces a carbon-dioxide rich liquid which is expanded, then sent to a second heat exchanger where it is heated by means of a fluid of the method, the exchanger carrying out an indirect heat exchange only between the carbon dioxide-rich liquid and the fluid of the method, the carbon dioxide-rich liquid at least partially vaporizes in the second exchanger and the vaporized gas formed heats up again in the first exchanger to form a carbon dioxide-rich gas which can be the end product of the method.

US patent application 2007/0204908 of Fogelman et al. discloses Dewars system with a heating thermoelectric devices for vapor generators from a liquid phase, such systems not usable for a reversible concept of gas to liquid conversion due both to the only heating capability of the thermoelectric devices as well as for the presence of one-way valves on the gas delivery circuit.

US patent application 2004/0089335 of Bingham et al. discloses fluid delivery system making use of thermoelectric devices installed on a limited and narrow portion of the device.

The thermoelectric effect is the direct conversion of temperature differences to electric voltage and vice versa. A thermoelectric device creates voltage when there is a different temperature on each side. Conversely, when a voltage is applied to it, it creates a temperature difference.

The term "thermoelectric effect" encompasses three separately identified effects: the Seebeck effect, Peltier effect, and Thomson effect. The Peltier effect is the presence of heating or cooling at an electrified junction of two different conductors. When a current is made to flow through a junction between two conductors, heat may be generated (or removed) at the junction.

The present invention makes use and exploit reversible thermoelectric effect, i.e. the capability of devices to both cause heating and cooling. One of the most widely used device exhibiting such behavior are Peltier devices, while devices just causing heating, such as Joule-Thomson based devices, are not suitable to carry out the present invention.

Use of the Peltier effect or Peltier device for fluid delivery and control is known for a long time, as described for example in U.S. Pat. No. 3,801,204 of Jennings et al. However, this patent does not contemplate carbon dioxide storage and liquefaction, and the systems therein described envision the use of a complex structure including plurality of generically defined annulus concentric channels.

SUMMARY

Methods and apparatus disclosed herein achieve an improved compression and delivery system for carbon dioxide with a simpler structure with respect the prior art, with particular reference to the number of stages involved, and in a first aspect thereof consists in a carbon dioxide compression and delivery system comprising a vessel having an inlet and an outlet, wherein the inlet is in contact with a carbon dioxide flow channel having an external wall and an inner wall, wherein carbon dioxide flows between said inner and external walls, wherein in contact with and external to said carbon dioxide flow channel are present a plurality of reversible thermoelectric devices, characterized in that the width of the carbon dioxide flow channel is comprised between 1.0 mm and 10 mm and wherein the minimum number of reversible thermoelectric devices is three, placed respectively in correspondence of the lower, middle and upper portion of the vessel.

The advantages of the present invention are associated with the absence of a mechanical pump for gas compression; this ensures that no contamination, either in the form of solid particles or in the form of chemical substances is added to the $CO_2$ stream.

Among one of the most useful application for example embodiments disclosed herein is carbon dioxide semiconductor cleaning.

These and other embodiments, features and advantages will become apparent to those of skill in the art upon a reading of the following descriptions and a study of the several figures of the drawings.

BRIEF DESCRIPTION OF THE DRAWINGS

Several example embodiments will now be described with reference to the drawings, wherein like components are provided with like reference numerals. The example embodiments are intended to illustrate, but not to limit, the invention. The figures have the sole purpose of illustrating the invention, and are not to be construed nor interpreted as limitation of its more general breadth as encompassed by the claims, furthermore some optional elements (piping, valves, electrical controls, . . . ) have not been depicted as not necessary for its comprehension by a person of ordinary skill in the art. The drawings include the following figures:

DETAILED DESCRIPTION OF EXAMPLE EMBODIMENTS

Figure 1:
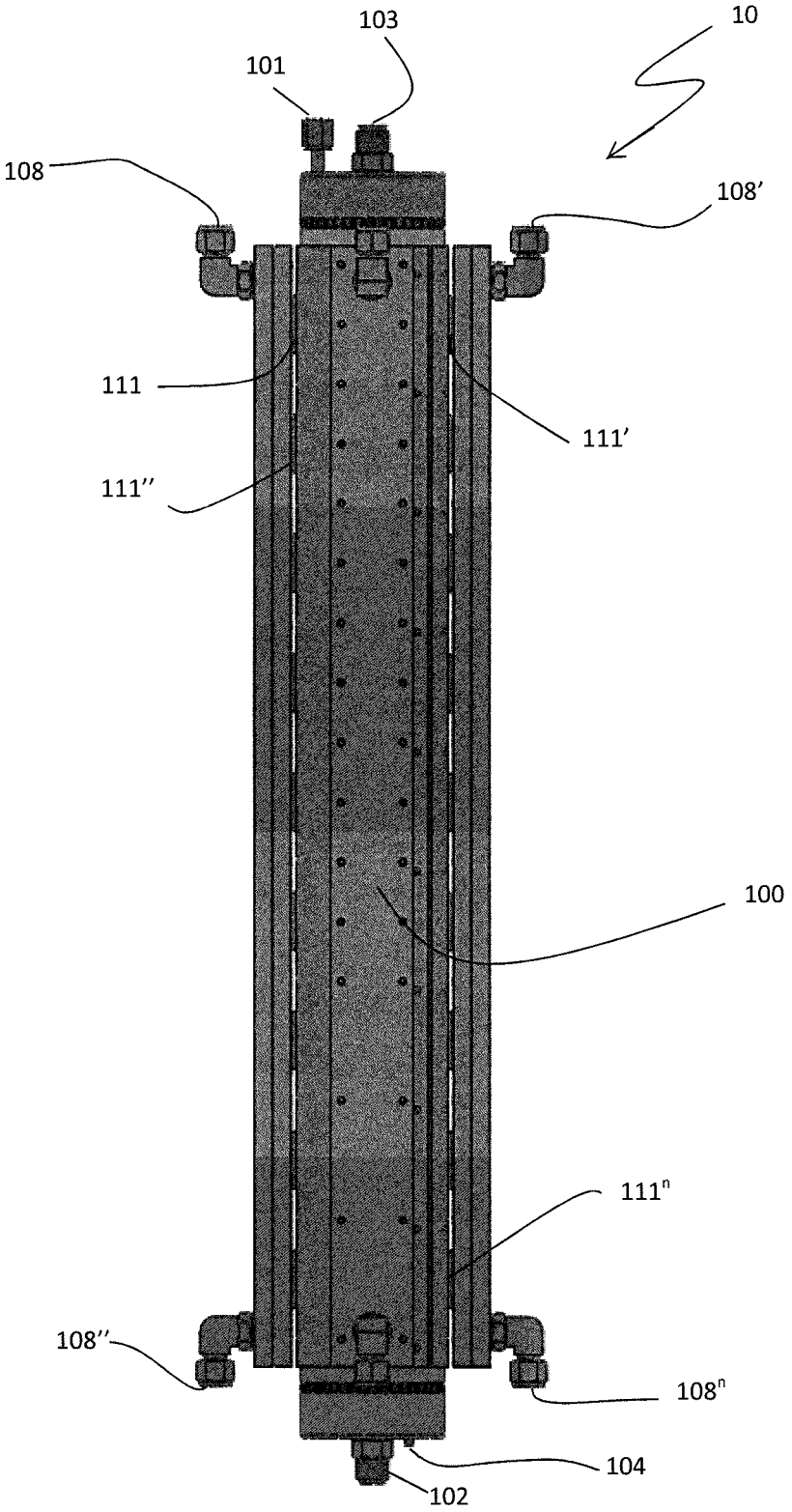
FIG. 1 is a side view of a carbon dioxide compression and delivery system shown according to the present invention.

It has been surprisingly discovered that a carbon dioxide compression and delivery system having a width of the carbon dioxide flow channel comprised between 1 and 10 mm and using a plurality of reversible thermoelectric devices, technical information and teaching not disclosed in any of the above referenced prior art, is specifically linked to the technical problem of $CO_2$ management (compression and delivery) via thermoelectric effect.

In the inventive concept of the present invention essentially the whole length of the system vessel, contributes to cooling (for carbon dioxide compression) and heating (for carbon dioxide delivery), meaning that the thermoelectric devices are ideally uniformly distributed over the length of vessel. In the minimal configuration this translates in the use of three thermoelectric devices placed in correspondence of the lower, middle, and upper portion of the carbon dioxide compression and delivery system vessel. This ensure a more efficient, in terms of speed and control, capability to store carbon dioxide in liquid form, and release it in gaseous form.

The term vessel identifies the container, suitable to hold the carbon dioxide both in liquid and gaseous form. In its simpler configuration a gas-tight cylinder with two openings, inlet and outlet. Vessel inlet is in contact with the incoming carbon dioxide supply via appropriate piping, fittings and valves, and similarly vessel outlet delivers the carbon dioxide in gaseous form, via appropriate piping, fittings and valves. Preferred and most common geometry for the vessel is cylindrical.

The terms lower and upper are to be considered relatively to the vessel inlet, in particular the carbon dioxide upper portion is the one proximate the vessel inlet, while the lower portion is the one far away from it. In a preferred embodiment, a reversible thermoelectric device placed on its upper portion means that its center placed in the first quarter (proximate to the inlet) of the carbon dioxide compression and delivery system vessel length, a reversible thermoelectric device placed in the middle portion means that its center is placed in between ⅓ and ⅔ of the vessel length, and finally, a reversible thermoelectric device placed in its lower portion means that its center placed in the last quarter (far away from the inlet) of the vessel length.

In a preferred embodiment the carbon dioxide flow channel is obtained by means of a flow diverter, that is an element running alongside and parallel to the internal surface of the vessel body. The gap between the diverter and the vessel body is the above defined width of the carbon dioxide flow channel. In this case the inner wall is given by the diverter surface facing the vessel body. Typically the diverter has the structure of an empty cylinder to that its external surface defines with the inner wall of the vessel the carbon dioxide flow channel, while its inner part accommodates liquid $CO_2$, during the appropriate system operational phase.

Diverter can be fixed to the vessel in many alternative ways functionally equivalent and known to a person skilled in the art, most commonly the design is welded, but whatever the technique the connection needs to be gas tight. The diverter being on the internal volume of the vessel is in fluid communication with its inlet via the surrounding empty space (the $CO_2$ flow channel given by the distance between the inner vessel surface and diverter surface). Another, although less preferable alternative solution for making the carbon dioxide flow channel is given by using a double walled vessel, or to be more precise by a vessel having an interspace abiding to the 1-10 mm geometrical constrains.

The 1-10 mm narrow range for the $CO_2$ channel is usefully obtained with diverter having a length comprised between 20 and 120 cm. Preferably the ratio between the diverter radius and the inner radius of the vessel body is comprised between 0.8 and 0.98, and more preferably between 0.9 and 0.97. In case of non-cylindrical geometries, possible albeit less preferable, this condition refers to the ratio of the inscribing diverter and inner vessel circumferences.

It has to be underlined that the carbon dioxide flow channel does not need to run along the whole length of the carbon dioxide compression and delivery system vessel, such case achieved when the diverter length is maximum, i.e. equal to the vessel length, but in a preferred embodiment a portion of the vessel, the lowest one, is free from such element. This ensures that there is no hindering of the system response when the reversible thermoelectric devices are switched from cooling to heating, as liquid to gas phase transition is very efficient, and the absence of a flow channel in a limited (lower) portion of the vessel ensures a direct contact with the heated (vessel) wall. In this regards, preferably the carbon dioxide flow channel has a length comprised between 0.25-0.75 of the length of the carbon dioxide compression and delivery system vessel.

Preferred reversible thermoelectric devices according to the present invention are standard Peltier devices. For the purposes of the present invention it is particularly advantageous the use of Peltier devices capable of providing a temperature delta between 40° C. to 65° C. with a heat removal power of 5 watts to 50 watts.

The reversible thermoelectric devices are preferably disposed over the external surface of the carbon dioxide flow channel and the distance between two adjacent devices is preferably comprised between 0.25 cm and 4 cm, where the distance is taken from the Peltier extremities and such distance parameter refers to the vertical or horizontal reciprocal placement of adjacent (vertical or horizontal) Peltier devices.

Even though the present invention is not limited by the specific way to fix the reversible thermoelectric devices to the carbon dioxide flow channel, such as for example, soldering, conductive thermal tape, insulating thermal tape, conducting gluing paste, it has been found that the use of a thermally conducting paste with a thermal conductivity value greater than 0.070 watt/m*K improves the system performances in terms of amount of $CO_2$ per hour generated by a single system vessel. In particular the inventors have been capable to consistently achieve 3.5 kg/hr with a system according to the present invention using such solution.

Preferably between 10% and 100% of the external surface of the carbon dioxide compression and delivery system vessel is covered by the active portion of the reversible thermoelectric devices (active portion is defined as the portion of the thermoelectric devices cooling or heating the contacting element).

One of the advantages of the present invention is that the system according to the present invention can easily and automatically switch between a load-compression phase to a delivery phase simply changing the current direction in the reversible thermoelectric device, so that differently from what shown in above referenced U.S. Pat. No. 6,889,508 and US patent application 2015/0253076 a single vessel may be suitably employed for the carbon dioxide compression and delivery.

One of the variant in the present invention envisions the use of two equal vessels operating in parallel in order to ensure continuous operation, so that when one is in the loading/compression phase (thermoelectric device cooling the carbon dioxide flow channel wall), the other one is instead delivering carbon dioxide (thermoelectric device heating the carbon dioxide flow channel).

Figure 2:
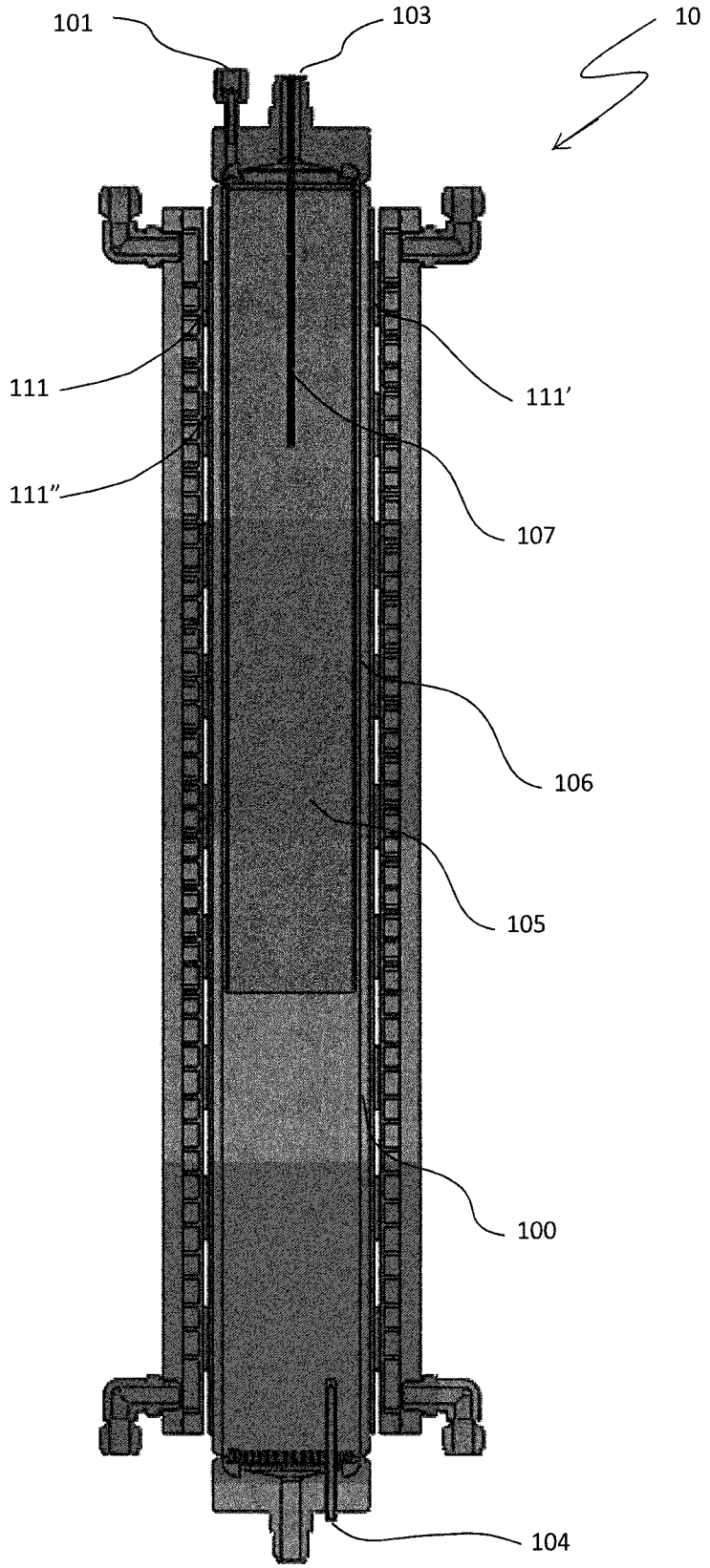
FIG. 2 is the cross-sectional view of the FIG. 1.

Preferred geometry for the vessel of the carbon dioxide compression and delivery system according to the present invention is cylindrical, as depicted in FIG. 1, showing a side view of a single vessel system according to the present invention, while its cross sectional view is shown in FIG. 2.

Those figures show a single vessel carbon dioxide compression and delivery system subassembly 10 with a vessel body 100, having a subassembly inlet 101 and a subassembly outlet 102 connected to vessel body 100, an upper venting port 103, and lower thermocouple 104 (lower refers to this element proximity to subassembly outlet 102', and consequently vessel outlet). This system subassembly has a flow diverter 105 running inside and parallel to the vessel body 100, and defining a gas passage 106 for gas flow. It is important to underline that in FIG. 2 diverter 105 is an empty cylinder, and the color difference (darker) with respect to lower vessel inner volume is used to indicate and show its extent, and is not an indication of an occupied space. Actually essentially the whole of the vessel inner volume is apt to be filled with carbon dioxide, either gaseous or liquid, with the exception of solid elements such as fitting, diverter wall (but not its body, being it a cave element), and other elements (vent tube, thermocouples) better described later on.

Gas passage 106 is in communication with subassembly inlet 101 and is the carbon dioxide flow channel. On the external surface of the vessel body 100 are present a plurality of Peltier devices 111, 111', 111", . . . , 111$^{n}$, which will heat and cool vessel body 100. System subassembly 10 further comprises a plurality of piping fittings, 108, 108', 108", . . . 108$^{n}$ to allow for a fluid flow to improve heat transfer/dissipation by the Peltier devices.

Such fluid flow could be for example water, with a flow rate preferably comprised between 4.7 liter/min to 6.6 liter/min.

FIGS. 1 and 2 show a preferred embodiment of the present invention, in which the carbon dioxide compression and delivery system has a sensing thermocouple 104 for measuring the temperature of the lower part of the vessel for checking the temperature of the carbon dioxide in the different modes, delivery/compression.

In preferred embodiment, the present invention envisions the presence of a liquid carbon dioxide sensor for determining the filling level of liquid carbon dioxide. Venting port 103, with venting tube 107 usefully placed in the upper part of the vessel (close to the inlet), may fulfill this purpose in addition to provide some other advantages. In particular, in addition to discarding part of the $CO_2$ so that by expansion through an orifice (not shown) it may provide cooling in case of gas to gas heat exchanging, or more in general provide a pre-cooling stage for the incoming carbon dioxide. Also as this venting is in the portion of the vessel at the highest temperature in operation (to be interpreted in the context of the present invention, and therefore typically comprised between −30° C. and 30° C.), gas discharging will also remove/decrease contaminants with a higher liquefaction temperature, improving the quality of the $CO_2$ released by the system outlet. The venting tube 107 is designed to shuttle liquid $CO_2$ out of the vessel during the Condensing Sequence. The venting tube is set at specific height in relation to 103. The length of the Vent tube 107 and ensures that there is a headspace (open area) above the $CO_2$ liquid level, this headspace prevents over-pressurization of the compression vessel 100 when the liquid $CO_2$ is heated and pressurized to its delivery pressure. Preferred design allows for a 10-30% headspace above the liquid level within the compression vessel, thus the length of the Vent Tube going inside the vessel is comprised between 10-30% of the length of the vessel. Coming to the portion of the vent tube exiting from the system, even though not critical for the purposes of the present invention, it is usually short, typically less than 5 cm in length, in principle also a zero length external portion of the vent tube is possible, in this case the vent tube ends in correspondence of the system inlet.

The compression vessel is considered to be full once liquid $CO_2$ is vented out of the compression vessel through the vent tube 107. A thermocouple above the vessel monitors the temperature of the vented $CO_2$ and when the vented $CO_2$ goes from gas phase to liquid phase there is rapid drop in temperature (10 C to −10 C), thus the indication that the vessel is full of liquid $CO_2$. The distance between the thermocouple sensing tip and the terminal part of the vent tube 107 is preferably comprised between 0 and 10 cm. 0 cm indicated the case in which the thermocouple is almost in contact with the vent tube external extremity.

As shown in FIG. 2 flow diverter 105 may be present only for a certain part of carbon dioxide compression and delivery system vessel 100.

FIGS. 1 and 2 are devoted to the core of the carbon dioxide compression and delivery system, i.e. the vessel structure with the $CO_2$ channel flow on its inside and the reversible thermoelectric elements placement. In some embodiments the full system may envision the presence of automatic valves at the inlet and outlet, the presence of a "twin" vessel for continuous operation, an inlet heat exchanger to lower the temperature from ambient to −15° C. to −25° C. Such heat exchanger being commonly known in the technical field, and can be of the type of gas to gas, or gas to liquid; the latter being preferred, with water being the liquid media.

The preferred system operating pressure is comprised between 20 and 24 bars during the loading phase, while when the system is switched to the delivery phase, current in the thermoelectric devices is reversed to change from cooling mode to heating mode, consequently temperature is increased from about 23° C. to the delivery temperature, usefully comprised between 0° C. and 30° C., with a carbon dioxide delivery pressure usefully comprised between 30 and 70 bar, preferably between 55 and 60 bar, with an ideal set-point at 58 bar. In the event the system is run at inlet pressure less than 20 bars and/or the flow capacity must be increased it is necessary to increase the cooling capability of the system, for example by the addition of extra cooling, as shown in FIG. #4. The extra cooling capacity can help to decrease the inlet pressure (6.7 bar) and increase the quantity of liquid $CO_2$ throughput.

Figure 3:
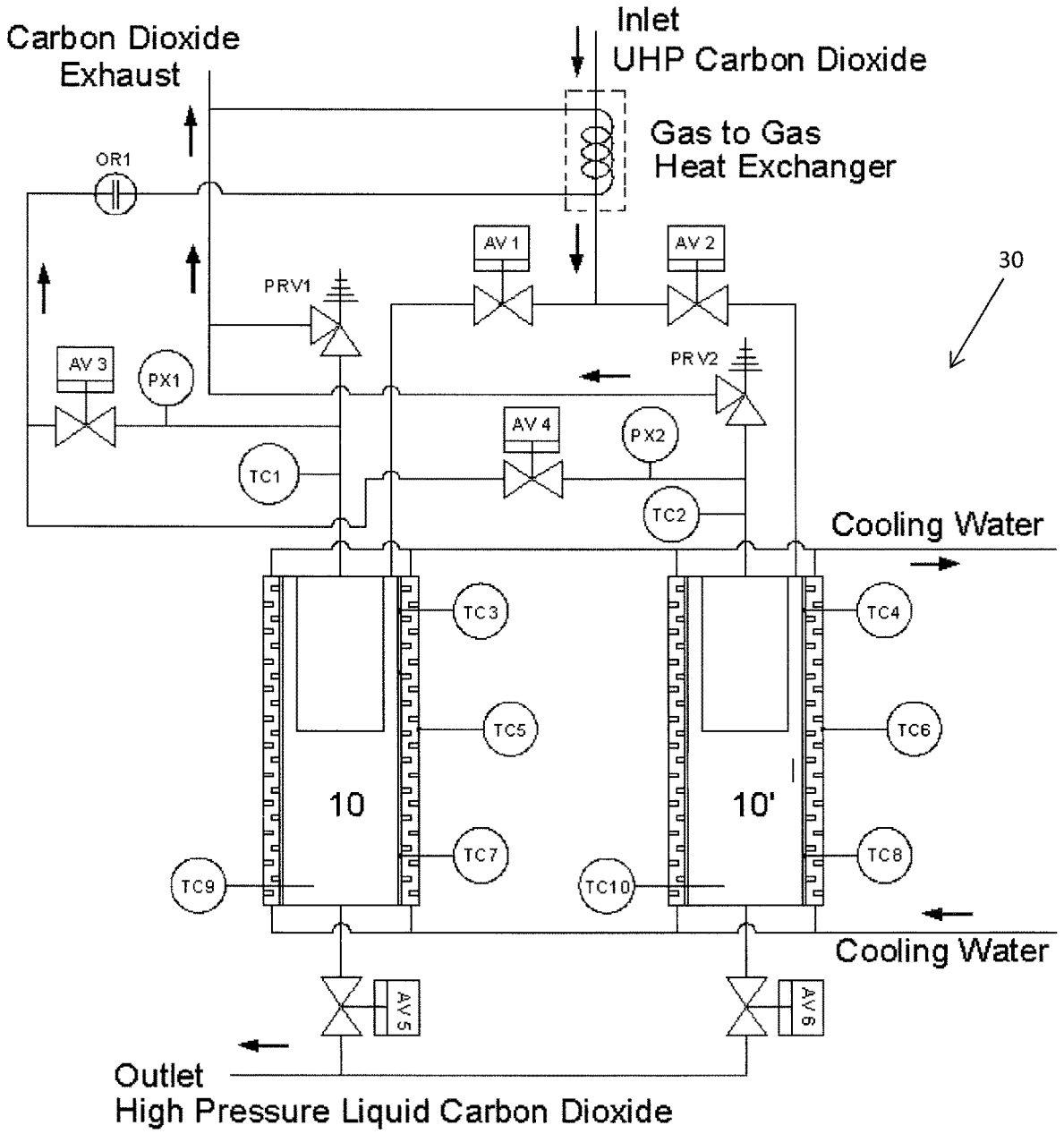
FIG. 3 is a schematic gas circuit representation for a twin-vessel carbon dioxide compression and delivery system made according to the present invention.

A gas circuit schematic representation for a twin-vessel carbon dioxide compression and delivery system made according to a preferred embodiment of the present invention is shown in FIG. 3. Carbon dioxide compression and delivery system 30 comprises two vessels 10, 10' connected in parallel for continuous operation ($CO_2$ supply), it has a gas to gas heat exchanger placed at the system inlet for carbon dioxide pre-cooling, and the system comprises the following elements:

- Automatic valves Av1 and Av2, for inlet vessel switching,
- Automatic valves Av3 and Av4, for vessel venting, and the release of light volatile impurities,
- Automatic valves Av5 and Av6, for outlet vessel switching,
- Pressure transducers PX1, PX2 for pressure monitoring,
- Thermocouples TC1, TC3, TC5, TC7, TC9 for vessel 10 temperature monitoring, thermocouples TC2, TC4, TC6, TC8, TC10 for vessel 10' temperature monitoring, more specifically:
  - TC1 and TC2 to monitor the CO2 temperature vented out of the vessel (used as filling sensor indicator),
  - TC3, TC5, TC4, TC6, to monitor the temperature in close proximity of the carbon dioxide flow channel,
  - TC7 and TC8 to monitor the temperature at the bottom of the vessel,
  - TC9 and TC10, in normal operation to monitor the liquid temperature on the inside of the vessel,
- Orifice OR1 meters the CO2 release from the vessel during the condensing sequence. In FIG. 3 schematic only one orifice is used for a twin vessel system, as the same orifice is connected to both vessels via valves Av3 (for vessel 10) and Av4 (for vessel 10')
- PRV1 and PRV2 prevent over-pressurization of the system compression and delivery system vessels.

It is to be emphasized that all the above elements are inherent to an exemplary embodiment according to the present invention. Among its most common variants there could be the removal of useful but not essential items, such as the number of thermocouples, as at the very low end the system can operate with just one thermocouple, or on the opposite side, the addition of further valves and other flow control elements, and even the addition of a third vessel and its associated controls. All of those variants are within the scope of the present invention as easily conceivable by a person of ordinary skill in the art.

Figure 4:
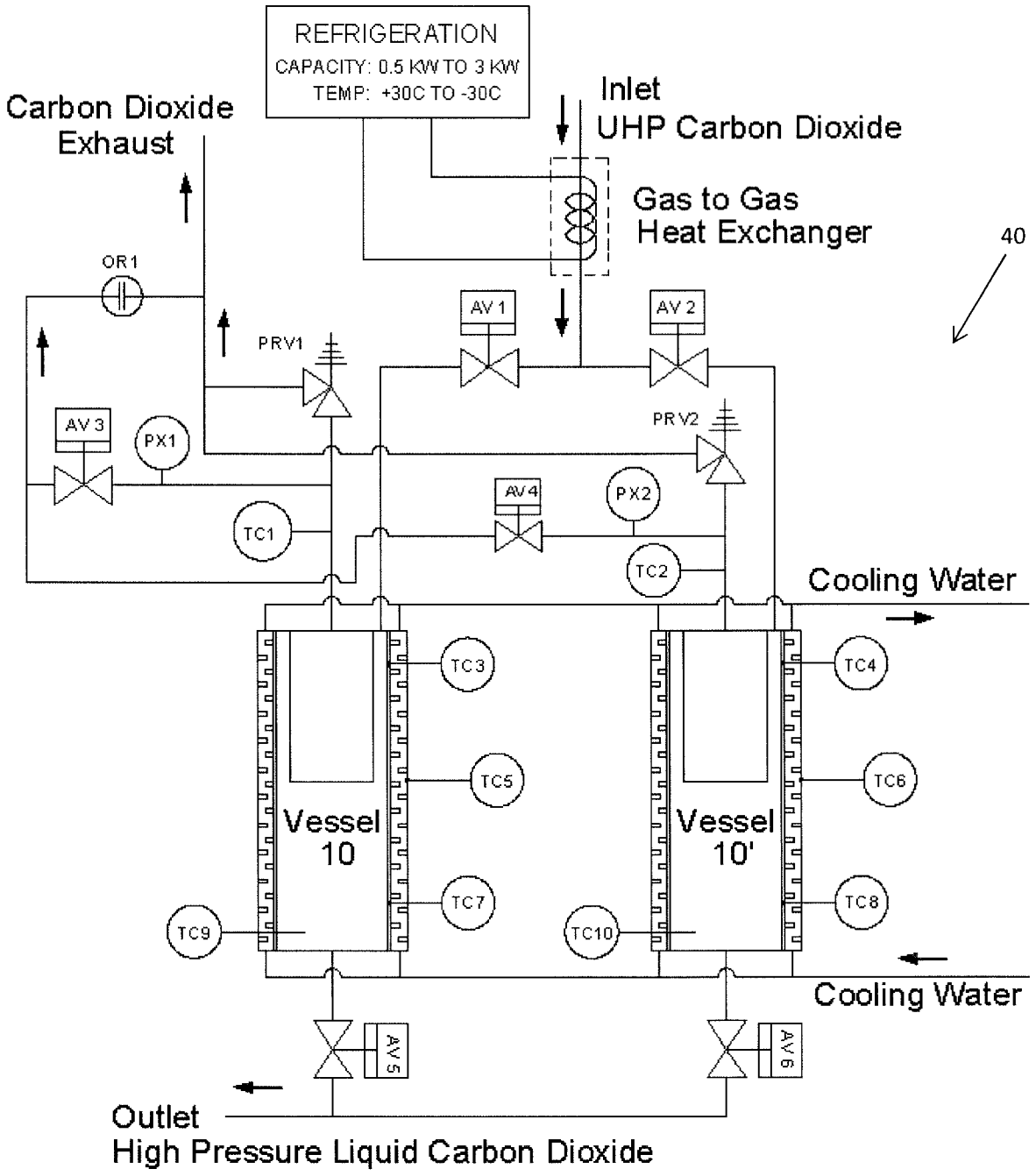
FIG. 4 shows a variant for a twin-vessel carbon dioxide compression system according to FIG. 3, with additional cooling capability.

A particularly relevant variant of the FIG. 3 scheme is shown in FIG. 4. In this case the carbon dioxide compression and delivery system 40, presents an additional element, a refrigeration unit mounted on the system inlet. Usefully such system has a refrigeration capacity comprised between 0.5 kW and 3 kW. The presence of such system implies that OR1 is no more connected with the gas to gas heat exchanger that now is fully dependent from the refrigeration unit. As mentioned above this variant is particularly useful for systems that needs to be operated with a lower inlet pressure (less than 20 bars) or that requires a higher throughputs.

FIGS. 3 and 4 show two vessels system, but the presence of the gas to gas heat exchanger and optional upstream additional refrigeration system can be used in single vessel system as well as in carbon dioxide compression and delivery systems using more than two vessels.

The following Table 1 shows the statuses of the system and the associated valves configuration in order to have one vessel in generation mode and the other in preparation or ready for the switch, to ensure a continuous $CO_2$ generation. This table, the following one and any consideration on status and their sequencing is in common between FIG. 3 and FIG. 4 embodiments.

TABLE 1 status sequences for a two vessel system

| Status id | Vessel 10 status | AV1 | AV3 | AV5 | Vessel 10' status | AV2 | AV4 | AV6 |
|---|---|---|---|---|---|---|---|---|
| 1 | Delivery | Close | Close | Open | Vent | Closed | Open | Close |
| 2 | Delivery | Close | Close | Open | Condensing | Open | Open | Close |
| 3 | Delivery | Close | Close | Open | Pressurizing | Close | Open | Close |
| 4 | Delivery | Close | Close | Open | Equalization | Close | Close | Open |
| 5 | Vent | Closed | Open | Close | Delivery | Close | Close | Open |
| 6 | Condensing | Open | Open | Close | Delivery | Close | Close | Open |
| 7 | Purge | Close | Close | Open | Delivery | Close | Close | Close |
| 8 | Pressurizing | Close | Open | Close | Delivery | Close | Close | Open |
| 9 | Equalization | Close | Close | Close Open | Delivery | Close | Close | Open |

In Table 1 vessel status colored in grey have the reversible thermoelectric devices set to heating, while the one with the white background indicate vessel statuses with the reversible thermoelectric devices set to cooling.

Typical durations are instead indicated in Table 2 for all phases with the exception of delivery, whose duration is function of the twin vessel non-delivery phases, it is typically the sum of these phases (vent, condensing, purge, pressurizing, equalization).

TABLE 2 typical system statuses durations

| Vessel status | Duration |
|---|---|
| Vent | 1 to 5 min |
| Condensing | 15 to 45 min |
| Pressurizing | 5 to 30 min |
| Equalization | 0 to 20 min |

The method illustrated above, in terms of number of vessels involved, number of phases and their durations, is only exemplary and reflects the best mode to carry out the invention, that in a second aspect thereof is inherent to a method for carbon dioxide compression by using a carbon dioxide compression and delivery system according to the present invention. In case of a single vessel the required phases are condensing, pressurizing and delivery, and could be achieved in the simplest form by controlling the thermoelectric supply current in order to switch from heating to cooling the carbon dioxide flow channel, and inlet and outlet valves.

In the most general case of two vessels carbon dioxide compression and delivery system, the vessels are sequenced in such a way that the first vessel and the second vessel are alternatively in the delivery phase.

Although various embodiments have been described using specific terms and devices, such description is for illustrative purposes only. The words used are words of description rather than of limitation. It is to be understood that changes and variations may be made by those of ordinary skill in the art without departing from the spirit or the scope of various inventions supported by the written disclosure and the drawings. In addition, it should be understood that aspects of various other embodiments may be interchanged either in whole or in part. It is therefore intended that the claims be interpreted in accordance with the true spirit and scope of the invention without limitation or estoppel.

The invention claimed is:

1. A carbon dioxide compression and delivery system comprising a vessel having an inlet, an outlet and a body, wherein the inlet is in contact with a carbon dioxide flow channel having an external wall and an inner wall, wherein carbon dioxide flows between said inner and external walls, wherein in contact with and external to said carbon dioxide flow channel are present a plurality of reversible thermoelectric devices, wherein a width of the carbon dioxide flow channel is between 1.0 mm and 10 mm and a minimum number of reversible thermoelectric devices is three, placed respectively in correspondence of the lower, middle and upper portion of the vessel, wherein said carbon dioxide flow channel is formed by a gap between a hollow flow diverter in fluid communication with the inlet and the vessel body inner surface, wherein the system further comprising two vessels connected in parallel and alternatively operating, and wherein the system is configured to perform a step of condensing carbon dioxide during which the reversible thermoelectric devices are configured to cool the carbon dioxide flow channel, the inlet is opened, and the outlet is closed.

2. A carbon dioxide compression and delivery system according to claim 1, further comprising a carbon dioxide liquid sensor level.

3. A carbon dioxide compression and delivery system according to claim 2, wherein the carbon dioxide liquid sensor level comprises a sensing thermocouple placed at a distance of less than 10 cm from an outlet of a vent tube, said vent tube going through the vessel inlet.

4. A carbon dioxide compression and delivery system according to claim 3, wherein a length of said vent tube inside the carbon dioxide compression and delivery system vessel is located at the top of the vessel and is comprised between 10% and 30% of a length of the compression vessel.

5. A carbon dioxide compression and delivery system according to claim 1, wherein the vessel is cylindrical.

6. A carbon dioxide compression and delivery system according to claim 1, wherein a length of the carbon dioxide flow channel is comprised between 20 cm and 120 cm.

7. A carbon dioxide compression and delivery system according to claim 1 wherein a length of the carbon dioxide flow channel is between 0.25 to 0.75 of a length of the carbon dioxide compression and delivery system vessel.

8. A carbon dioxide compression and delivery system according to claim 7, wherein the carbon dioxide flow channel begins in correspondence of the vessel inlet.

9. A carbon dioxide compression and delivery system according to claim 1 wherein the ratio between a diverter radius and an inner radius of the vessel is between 0.80 and 0.98.

10. A carbon dioxide compression and delivery system according to claim 1, wherein said plurality of reversible thermoelectric devices are Peltier thermoelectric devices.

11. A carbon dioxide compression and delivery system according to claim 10, wherein the Peltier devices are in contact with an external surface of the carbon dioxide compression and deliver system vessel, and a distance between two adjacent Peltier devices is between 0.25 and 4 cm.

12. A carbon dioxide compression and delivery system according to claim 10 wherein a heat removal power of the Peltier thermoelectric devices is between 5 to 50 Watts.

13. A carbon dioxide compression and delivery system according to claim 10, wherein said Peltier thermoelectric devices are connected to the carbon dioxide compression and delivery system vessel by a thermally conducting paste.

14. A carbon dioxide compression and delivery system according to claim 1, wherein between 10% and 100% of an external surface of the carbon dioxide compression and deliver system vessel is covered by the reversible thermoelectric devices.

15. A carbon dioxide compression and delivery system according to claim 1, wherein a sensing thermocouple is present in the lower portion of the system.

16. A carbon dioxide compression and delivery system according to claim 1, wherein the vessel inlet is connected to a gas to gas heat exchanger.

17. A carbon dioxide compression and delivery system according to claim 16, wherein the gas to gas heat exchanger is downstream of a refrigeration system.

18. A carbon dioxide compression and delivery system according to claim 9, wherein the ratio between the diverter radius and the inner radius of the vessel is between 0.9 and 0.97.

19. A carbon dioxide compression and delivery system according to claim 1, further comprising a source of carbon dioxide connected to the inlet.

* * * * *